US008469014B2

(12) United States Patent
Hu

(10) Patent No.: US 8,469,014 B2
(45) Date of Patent: Jun. 25, 2013

(54) BULLET LOADER FOR TOY GUN

(76) Inventor: Shih-Che Hu, Tainan (TW)

( * ) Notice: Subject to any disclaimer, the term of this patent is extended or adjusted under 35 U.S.C. 154(b) by 251 days.

(21) Appl. No.: 13/044,545

(22) Filed: Mar. 10, 2011

(65) Prior Publication Data

US 2012/0060810 A1 Mar. 15, 2012

(30) Foreign Application Priority Data

Sep. 9, 2010 (TW) ..... 99217497 U

(51) Int. Cl.
*F41F 1/00* (2006.01)

(52) U.S. Cl.
USPC ..... 124/51.1; 221/183; 221/200; 221/202; 221/208

(58) Field of Classification Search
USPC ..... 124/45, 51.1, 52, 82, 78; 221/200, 221/202, 208, 224, 268, 270, 271, 272, 273, 221/276, 281, 178, 183; 222/78, 79, 221
See application file for complete search history.

(56) References Cited

U.S. PATENT DOCUMENTS 2,870,937 A * 1/1959 Telly ..... 221/22
3,410,452 A * 11/1968 Igel et al. ..... 221/13
4,230,236 A * 10/1980 Boulter ..... 221/190
4,405,060 A * 9/1983 Hsei ..... 221/135
4,564,125 A * 1/1986 Esslinger ..... 221/288
5,816,441 A * 10/1998 Farside ..... 221/152
2004/0149275 A1* 8/2004 Vincent ..... 124/41.1
2005/0098576 A1* 5/2005 Fenton et al. ..... 221/276
2007/0261688 A1* 11/2007 Tam ..... 124/52
2008/0029076 A1* 2/2008 Liang ..... 124/51.1
2008/0236558 A1* 10/2008 Bosch et al. ..... 124/48

* cited by examiner

*Primary Examiner* — Alvin Hunter
*Assistant Examiner* — John E Simms, Jr.
(74) *Attorney, Agent, or Firm* — Pro-Techtor Int'l Services

(57) ABSTRACT

A bullet loader for inserting toy bullets into a magazine is disclosed to include a housing having a bullet chamber, opposing inlet and outlet and a bullet passage in communication between the bullet chamber and the outlet, a press-control device having a press knob and a plunger extended from the press knob and inserted into the bullet chamber and terminating in a repeatedly curved lower plunger portion for pushing toy bullets out of the bullet passage into the outlet, a movable block coupled to the plunger in and horizontally reciprocatable by the repeatedly curved lower plunger portion to turn over storage toy bullets upon a vertical reciprocating motion of the plunger relative to the housing.

8 Claims, 6 Drawing Sheets

BULLET LOADER FOR TOY GUN

BACKGROUND OF THE INVENTION

1. Field of the Invention

The present invention relates to magazine bullet loading technology and more particularly, to a bullet loader for inserting toy bullets into a magazine, which avoids bullet sticking in the bullet chamber, facilitating bullet loading.

2. Description of the Related Art

Regular toy guns (air soft guns BB-guns) are commonly shaped like a real gun and can be attached with a magazine for shooting plastic toy bullets. A magazine for toy gun can carry a big number of plastic toy bullets. When playing a toy gun, the player can repeatedly operate the trigger to shoot plastic toy bullets out of the barrel one after another. When the magazine of a toy gun is empty, the user must insert plastic toy bullets into the magazine manually. When inserting a plastic toy bullet into the magazine, the user must apply much effort to overcome the pressure of the magazine spring. This manual bullet loading method wastes much time and labor.

In view of the aforesaid problem, a bullet loader is created for inserting plastic toy bullets into a magazine. This design of bullet loader comprises a housing for accommodating toy bullets, and a plunger for pushing storage toy bullets out of the housing into a magazine. The housing comprises a bullet chamber for accommodating toy bullets, a guide tube connectable to a feed hole of a magazine, and a bullet passage in communication between the bullet chamber and the guide tube. During application, attach the guide tube to the feed hole of the magazine, and then reciprocate the plunger to push storage toy bullets out of the bullet passage into the guide tube and then the feed hole of the magazine. However, because the bullet passage is a detoured passage, toy bullets may be stuck in the bullet passage during operation of the plunger (the operation principle of the bullet loader can refer to Taiwan Patent M283155), interfering with the bullet loading operation. Therefore, an improvement in this regard is necessary.

SUMMARY OF THE INVENTION

The present invention has been accomplished under the circumstances in view. It is therefore the main object of the present invention to provide a bullet loader for insertion toy bullets into a magazine, which facilitates feeding bullets into a magazine, avoiding bullet sticking in the housing of the bullet loader.

To achieve this and other objects of the present invention, a bullet loader comprises a housing, a press-control device and a movable block. The housing has defined therein a bullet chamber for accommodating toy bullets, an inlet and an outlet openably disposed in communication with the bullet chamber at two opposite sides, and a bullet passage in communication between the bullet chamber and the outlet. The press-control device is vertically reciprocatably installed in the housing, comprising a press knob and a plunger extended from the press knob and inserted into the inside of the bullet chamber in alignment with the outlet and adapted for pushing storage toy bullets out of the bullet passage into the outlet. The plunger has a repeatedly curved lower plunger portion suspending in the bullet chamber. The movable block is coupled to the plunger in the bullet chamber adjacent to the bullet passage and horizontally reciprocatable by the repeatedly curved lower plunger portion of the plunger of the press-control device to turn over storage toy bullets upon a vertical reciprocating motion of the plunger relative to the housing. The movable block comprises at least one communication port in communication with the bullet passage for guiding storage toy bullets out of the bullet chamber into the bullet passage upon a vertical reciprocating motion of the plunger relative to the housing.

Further, the inlet and outlet of the housing are respectively openably covered with a cover. The housing further comprises a first compartment for accommodating the press knob and a part of the plunger. The press-control device further comprises a spring member stopped between a part of the press knob and a bottom wall of the first compartment. The housing further comprises a second compartment disposed remote from the first compartment and adjacent to the outlet and openably covered with a respective cover, and at least one rail adapted for guiding the movable block to reciprocate horizontally in the bullet chamber. Further, the movable block comprises at least two transverse panels. Further, the communication port of the movable block is disposed at one side relative to the transverse panels.

Thus, by means of moving the repeatedly curved lower plunger portion of the plunger vertically up and down to reciprocate the movable block horizontally, storage toy bullets in front of the bullet passage are turned over and forced into the bullet passage in proper order, avoiding bullet sticking in the bullet chamber.

DETAILED DESCRIPTION OF THE PREFERRED EMBODIMENT

Figure 2:
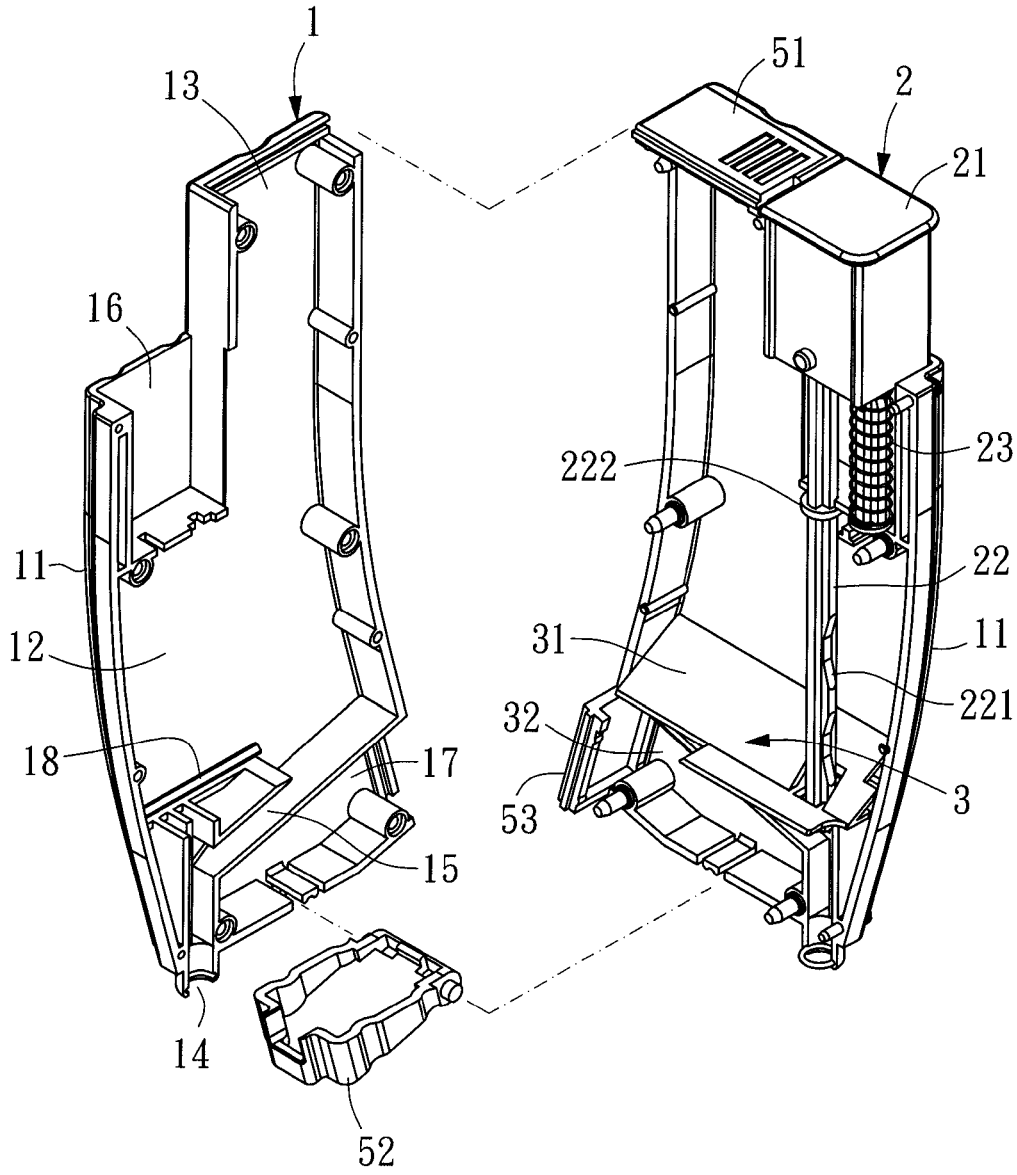
FIG. 2 is an exploded view, partially assembled, of the bullet loader for toy gun in accordance with the present invention.

Referring to FIG. 2, a bullet loader for toy gun in accordance with the present invention is shown comprising a housing 1, a press-control device 2 and a movable block 3.

Figure 1:
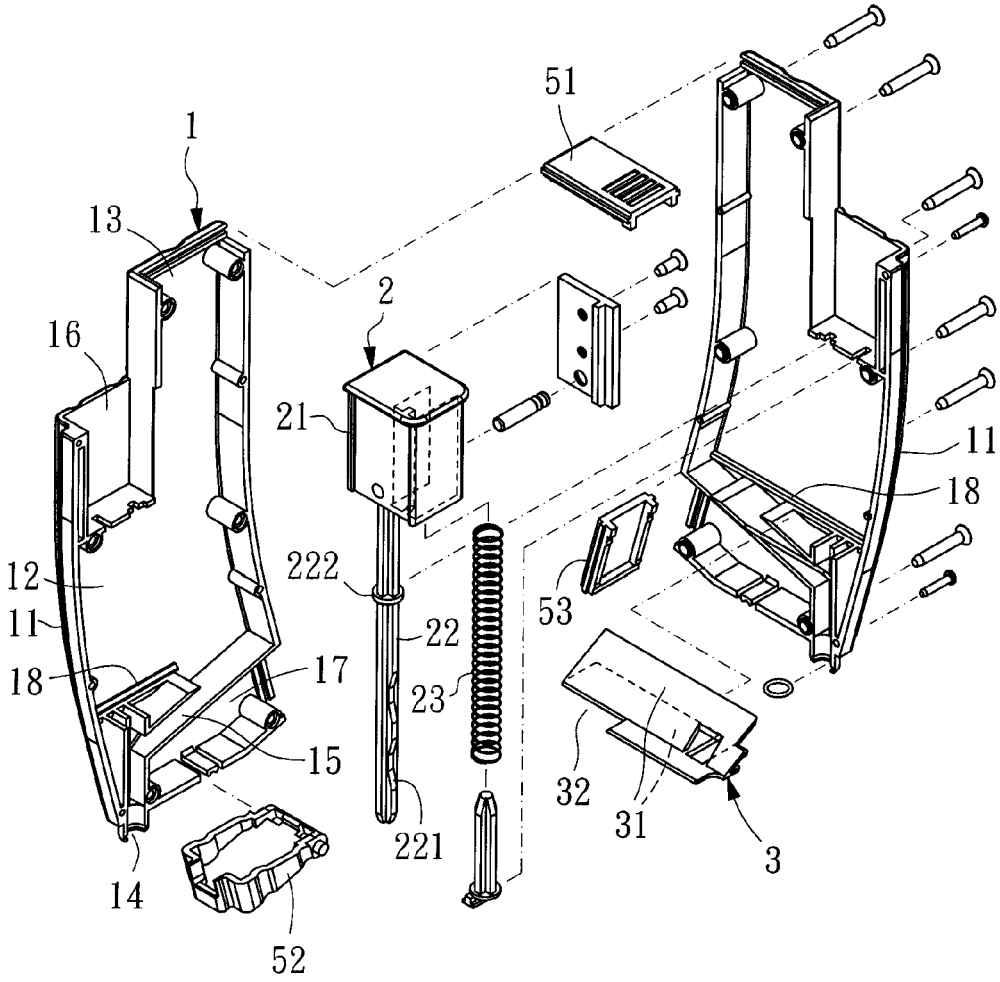
FIG. 1 is an exploded view of a bullet loader for toy gun in accordance with the present invention.
Figure 3:
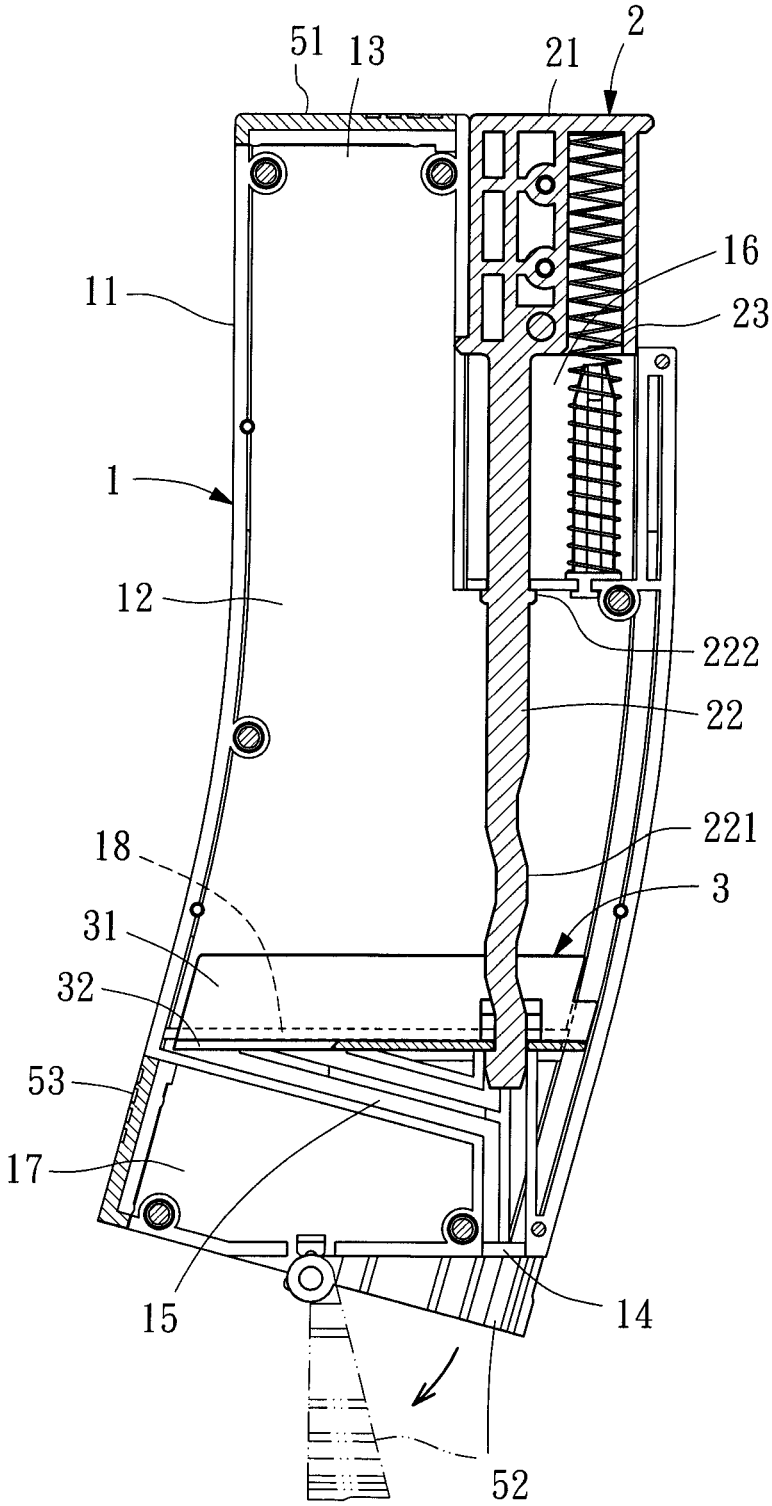
FIG. 3 is a schematic sectional plain view of the bullet loader for toy gun in accordance with the present invention.

The housing 1 consists of two symmetrical half shells 11, having defined therein a bullet chamber 12 (see FIG. 3) for accommodating toy bullets 4 (see FIGS. 5 and 6), opposing inlet 13 and outlet 14 (see FIG. 3) respectively and openably covered with a cover 51 and a cover 52, a bullet passage 15 in communication between the bullet chamber 12 and the outlet 14, a first compartment 16 disposed at one lateral side relative to the inlet 13, a second compartment 17 disposed remote from the first compartment 16 and adjacent to the outlet 14 and openably covered with a cover 53, and at least one, for example, two rails 18 respectively located on the two symmetrical half shells 11 inside the bullet chamber 12 (see FIG. 1).

The press-control device 2 is vertically reciprocatably installed in the housing 1, comprising a press knob 21, a plunger 22 extended from the press knob 21 and inserted through the first compartment 16 into the inside of the bullet chamber 12 in alignment with the outlet 14 (see FIG. 3), and an elastic member, for example, compression spring 23 stopped between the press knob 21 and an inside part of the first compartment 16 to impart a pressure to the press knob 21 toward the outside of the housing 1. When a user presses the press knob 21 to move the plunger 22 forwards toward the inside of the housing 1, the compression spring 23 is compressed (see FIG. 6). When the user releases the hand from the press knob 21, the compression spring 23 immediately pushes the press knob 21 backwards to its former position (see FIG. 5). The plunger 22 has a repeatedly curved lower plunger portion 221 suspending in the bullet chamber 12, and a stop flange 222 extending around the periphery above the repeatedly curved lower plunger portion 221 and stoppable at the bottom side of the bottom wall of the first compartment 16 to prohibit falling of the plunger 22 out of the housing 1 (see FIG. 3).

The movable block 3 is pivotally coupled to the plunger 22 of the press-control device 2 in the bullet chamber 12 in front of the bullet passage 15, comprising at least two transverse panels 31 (see FIG. 1) and at least one communication port 32 in communication with the bullet passage 15. The communication port 32 can be disposed at one lateral side relative to the transverse panels 31. The transverse panels 31 are adapted for turning over the toy bullets 4. When moving the plunger 22 of the press-control device 2 alternatively up and down, the movable block 3 will be forced by the repeatedly curved lower plunger portion 221 of the plunger 22 to reciprocate horizontally (see FIG. 6). Further, the respective lateral bottom sides of the transverse panels 31 are respectively supported on the rails 18 in the housing 1 (see FIG. 1 and FIG. 3). Thus, the rails 18 guide the movable block 3 to reciprocate stably along a predetermined direction.

Figure 4:
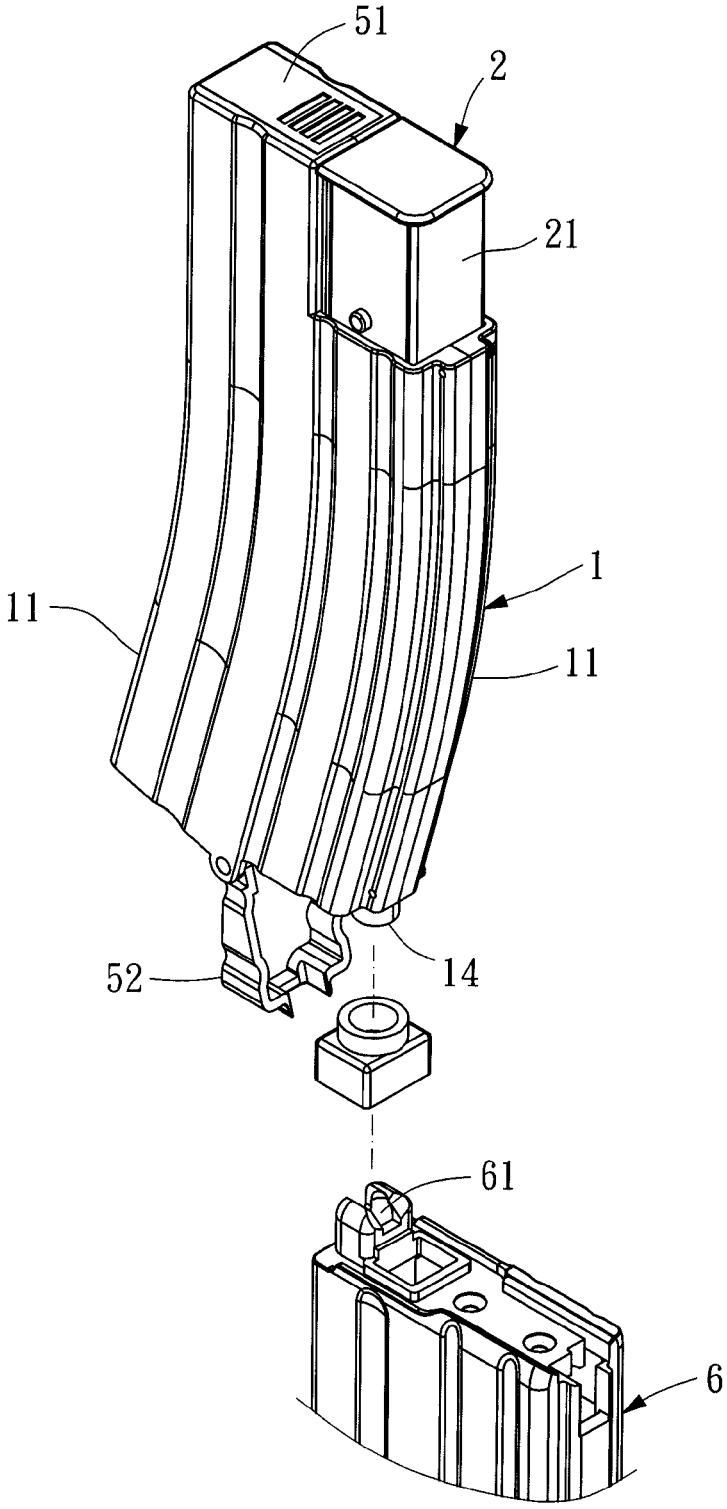
FIG. 4 is a schematic elevational view of the present invention, illustrating the relationship between the outlet of the bullet loader and a feed hole of a magazine.
Figure 5:
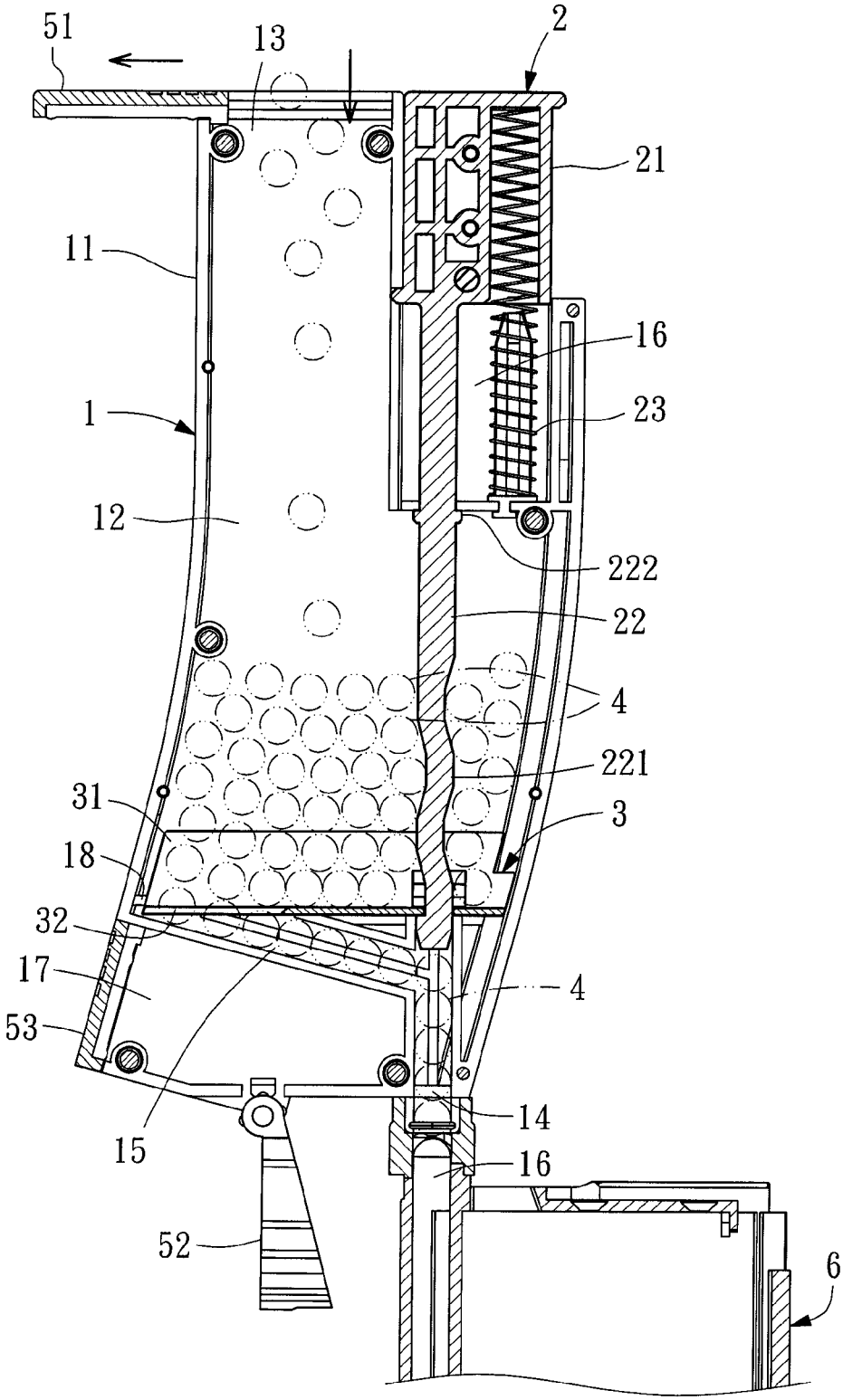
FIG. 5 is a schematic sectional plain view of the present invention, illustrating the outlet of the bullet loader attached to the feed hole of the magazine.
Figure 6:
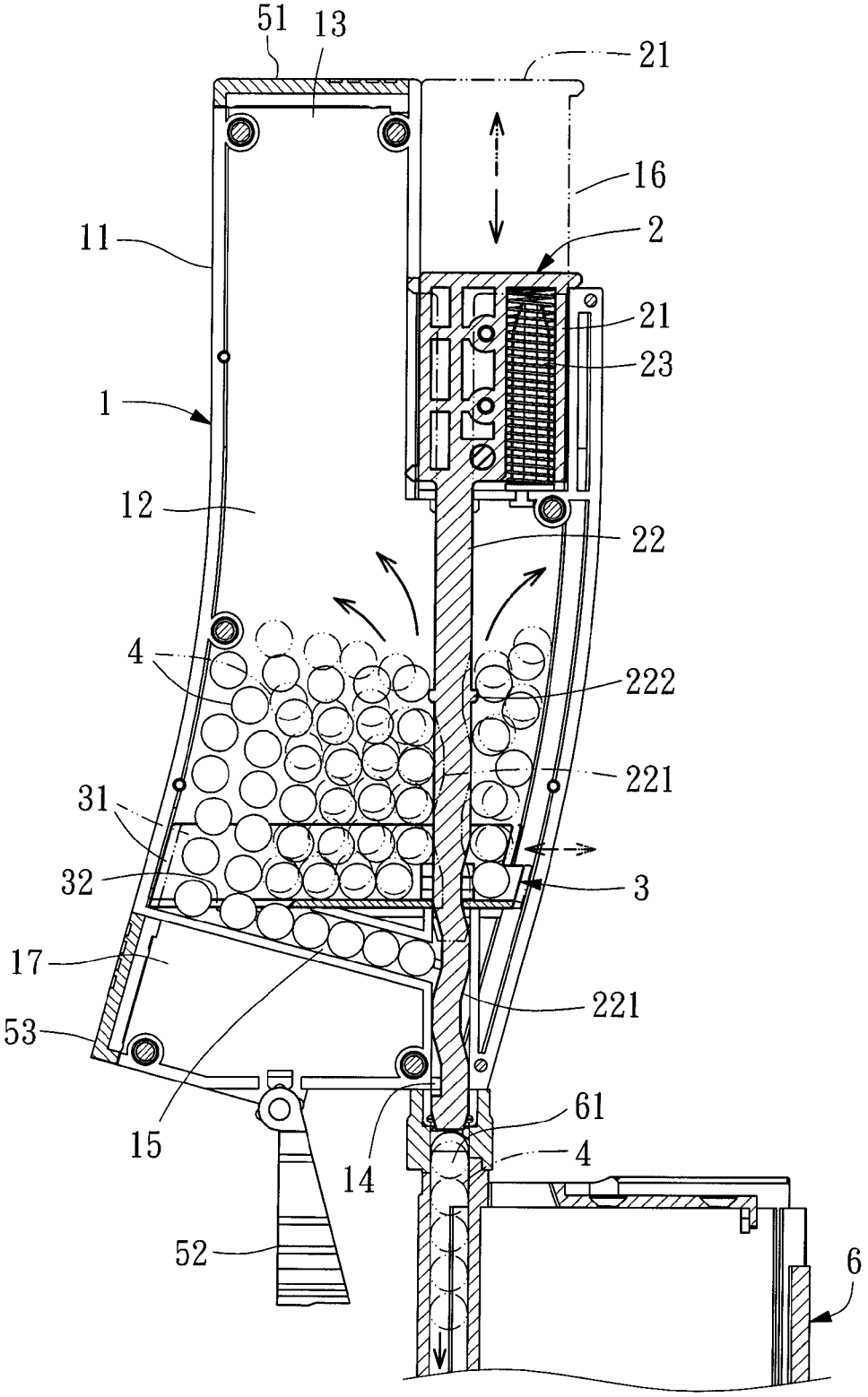
FIG. 6 corresponds to FIG. 5, illustrating the press-control device operated.

During application of the bullet loader, toy bullets 4 are fed into the bullet chamber 12 through the inlet 13 (see FIG. 5). When reloading a magazine 6 with the bullet loader, attach the outlet 14 of the housing 1 to a feed hole 61 of the magazine 6 (see FIGS. 4 and 5), and then repeatedly press and release the press knob 21 of the press-control device 2 to move the plunger 22 (see FIG. 6), causing the movable block 3 to be forced by the repeatedly curved lower plunger portion 221 of the plunger 22 to reciprocate horizontally and to turn over storage toy bullets 4 in front of the bullet passage 15, thereby forcing toy bullets 4 to move through the at least one communication port 32, the bullet passage 15 and the outlet 14 into the feed hole 61 of the magazine 6 in proper order.

As stated above, by means of moving the repeatedly curved lower plunger portion 221 of the plunger 22 vertically up and down to reciprocate the movable block 3 horizontally, storage toy bullets 4 in front of the bullet passage 15 are turned over and forced into the bullet passage 15 in proper order, avoiding bullet sticking in the bullet loader. Therefore, the invention effectively eliminates the drawbacks of the prior art design.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A bullet loader for inserting toy bullets into a magazine, comprising:

a housing having defined therein a bullet chamber for accommodating toy bullets, an inlet and an outlet openably disposed in communication with said bullet chamber at two opposite sides, and a bullet passage in communication between said bullet chamber and said outlet;

a press-control device vertically reciprocatably installed in said housing, said press-control device comprising a press knob and a plunger extended from said press knob and inserted into the inside of said bullet chamber in alignment with said outlet and adapted for pushing storage toy bullets out of said bullet passage into said outlet, said plunger having a repeatedly curved lower plunger portion suspending in said bullet chamber; and a movable block coupled to said plunger in said bullet chamber adjacent to said bullet passage and horizontally reciprocatable by said repeatedly curved lower plunger portion of said plunger of said press-control device upon a vertical reciprocating motion of said plunger relative to said housing, said movable block comprising at least one communication port in communication with said bullet passage for guiding storage toy bullets out of said bullet chamber into said bullet passage upon a vertical reciprocating motion of said plunger relative to said housing.

2. The bullet loader as claimed in claim 1, wherein said housing comprises a first compartment for accommodating said press knob and a part of said plunger; said press-control device further comprises a spring member supported between said press knob and said housing.

3. The bullet loader as claimed in claim 2, wherein said spring member is a compression spring stopped between a part of said press knob and a bottom wall of said first compartment.

4. The bullet loader as claimed in claim 3, wherein said inlet and said outlet of said housing are respectively openably covered with a cover.

5. The bullet loader as claimed in claim 4, wherein said housing further comprises a second compartment disposed remote from said first compartment and adjacent to said outlet and openably covered with a respective cover.

6. The bullet loader as claimed in claim 4, wherein said housing further comprises at least one rail adapted for guiding said movable block to reciprocate horizontally in said bullet chamber.

7. The bullet loader as claimed in claim 6, wherein said movable block comprises at least two transverse panels; said communication port is disposed at one side relative to said transverse panels.

8. The bullet loader as claimed in claim 6, wherein said plunger comprises a stop flange extending around the periphery thereof above said repeatedly curved lower plunger portion and stoppable at a bottom side of the bottom wall of said first compartment.

* * * * *